US011542804B2

(12) United States Patent
Ocegueda-Hernandez et al.

(10) Patent No.: US 11,542,804 B2
(45) Date of Patent: Jan. 3, 2023

(54) DOWNHOLE MOTOR STALL DETECTION

(71) Applicant: National Oilwell Vareo, L.P., Houston, TX (US)

(72) Inventors: Francisco Ocegueda-Hernandez, Houston, TX (US); Christopher P. Mullin, Dallas, TX (US); Ryan J. Hanford, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 713 days.

(21) Appl. No.: 16/391,461

(22) Filed: Apr. 23, 2019

(65) Prior Publication Data

US 2019/0323335 A1 Oct. 24, 2019

Related U.S. Application Data

(60) Provisional application No. 62/661,218, filed on Apr. 23, 2018.

(51) Int. Cl.
*E21B 44/06* (2006.01)
*E21B 4/02* (2006.01)
(Continued)

(52) U.S. Cl.
CPC ..... *E21B 44/06* (2013.01); *E21B 4/02* (2013.01); *E21B 44/005* (2013.01); *E21B 47/06* (2013.01); *E21B 21/08* (2013.01)

(58) Field of Classification Search
CPC ..... E21B 44/06; E21B 4/02; E21B 44/005; E21B 47/06; E21B 21/08
See application file for complete search history.

(56) References Cited

U.S. PATENT DOCUMENTS 5,448,911 A 9/1995 Mason
8,256,534 B2 9/2012 Byreddy et al.
(Continued)

FOREIGN PATENT DOCUMENTS

GB 2518282 B 12/2015
WO 2016162659 A1 10/2016
(Continued)

OTHER PUBLICATIONS

International Search Report and Written Report received in PCT Application No. PCT/US2019/028616, dated Aug. 1, 2019.
(Continued)

*Primary Examiner* — Andrew Schechter
*Assistant Examiner* — Jeremy A Delozier
(74) *Attorney, Agent, or Firm* — Harris Wilson & Christenson PLLC

(57) ABSTRACT

A drilling system includes a drill string, a plurality of sensors, and a computing system. The drill string includes a downhole motor. The sensors are coupled to the drill string. The computing system is coupled to the sensors. The computing system is configured to compute, based on measurements provided by the sensors, a motor stall index, and to determine, by comparing the motor stall index to a motor stall threshold, whether the downhole motor has stalled. The computing system is also configured to, responsive to a determination that the downhole motor has stalled, adjust operation of the drill string to restart the downhole motor.

20 Claims, 12 Drawing Sheets

(51) Int. Cl.

| | |
|---|---|
| ***E21B 44/00*** | (2006.01) |
| ***E21B 47/06*** | (2012.01) |
| *E21B 21/08* | (2006.01) |

(56) References Cited

U.S. PATENT DOCUMENTS

| | | | | |
|---|---|---|---|---|
| 2012/0118637 | A1 | 5/2012 | Wang | |
| 2012/0123756 | A1 | 5/2012 | Wang et al. | |
| 2013/0032407 | A1* | 2/2013 | Edbury | E21B 49/005 175/61 |
| 2014/0291023 | A1 | 10/2014 | Edbury et al. | |
| 2014/0326509 | A1 | 11/2014 | Hay et al. | |
| 2015/0053482 | A1 | 2/2015 | Boone | |
| 2015/0088468 | A1* | 3/2015 | Hohl | E21B 41/00 703/2 |
| 2015/0112949 | A1 | 4/2015 | Marland | |
| 2015/0345223 | A1* | 12/2015 | Maidla | E21B 47/12 175/26 |
| 2016/0265336 | A1 | 9/2016 | Benson | |
| 2017/0152741 | A1* | 6/2017 | Park | G01D 5/35316 |
| 2018/0135402 | A1* | 5/2018 | Jeffryes | E21B 44/06 |

FOREIGN PATENT DOCUMENTS

| | | | |
|---|---|---|---|
| WO | 2016176428 | A1 | 11/2016 |
| WO | 2017171557 | A1 | 10/2017 |

OTHER PUBLICATIONS

International Search Report and Written Report received in PCT Application No. PCT/US2019/028701, dated Aug. 5, 2019.

International Search Report and Written Report received in PCT Application No. PCT/US2018/056791, dated Jan. 15, 2019.

Extended European Search Report dated Dec. 21, 2021 in counterpart European Patent Application No. 19792822.9.

* cited by examiner

DOWNHOLE MOTOR STALL DETECTION

CROSS-REFERENCE TO RELATED APPLICATIONS

The present application claims priority to U.S. Provisional Patent Application No. 62/661,218, filed Apr. 23, 2018, entitled "Systems and Methods for Detecting, Mitigating, and Correction Downhole Motor Stall During Drilling Operations," which is hereby incorporated herein by reference in its entirety.

BACKGROUND

The present disclosure relates generally to subterranean drilling operations for the ultimate recovery of oil, gas, or minerals. More particularly, the disclosure relates to systems and methods for predicting and detecting downhole motor stall, preemptively addressing a potential motor stall, and correcting an actual motor stall in real time or near real time.

In drilling a borehole into an earthen formation, such as for the recovery of hydrocarbons or minerals from a subsurface formation, it is conventional practice to connect a drill bit onto the lower end of a drillstring formed from a plurality of pipe joints connected together end-to-end, and then rotate the drill string so that the drill bit progresses downward into the earth to create a borehole along a predetermined trajectory. In addition to pipe joints, the drillstring typically includes heavier tubular members known as drill collars positioned between the pipe joints and the drill bit. The drill collars increase the vertical load applied to the drill bit to enhance its operational effectiveness. Other accessories commonly incorporated into drill strings include stabilizers to assist in maintaining the desired direction of the drilled borehole, and reamers to ensure that the drilled borehole is maintained at a desired gauge (i.e., diameter). In vertical drilling operations, the drillstring and drill bit are typically rotated from the surface with a top dive or rotary table.

During the drilling operations, drilling fluid or mud is pumped under pressure down the drill string, out the face of the drill bit into the borehole, and then up the annulus between the drill string and the borehole sidewall to the surface. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

Recently, it has become increasingly common and desirable in the oil and gas industry to drill horizontal and other non-vertical or deviated boreholes (i.e., "directional drilling"), to facilitate greater exposure to and production from larger regions of subsurface hydrocarbon-bearing formations than would be possible using only vertical boreholes. In directional drilling, specialized drill string components and bottom hole assemblies (BHAs) are often used to induce, monitor, and control deviations in the path of the drill bit, so as to produce a borehole of the desired deviated configuration.

Directional drilling is typically carried out using a downhole or mud motor provided in the BHA at the lower end of the drillstring immediately above the drill bit. Downhole motors typically include a stator with a helical internal bore in which a helical rotor is positioned and can eccentrically rotate. The outer surface of the rotor and the inner surface of the stator are both helical and together create hollow chambers between their contact points. These chambers advance from one end of the stator towards the other end during the rotation of the rotor relative to the stator. Each of these chambers is isolated and sealed from the other chambers. An elastomeric material is commonly used as a coating on the stator inner walls that contact the rotor. The elastomeric material of the stator can be damaged when the stress and strain limits of the elastomer are exceeded, as well as when the temperature of the elastomeric material exceeds its rated temperature for a prolonged period of time. Damage to the elastomeric material can reduce the operational effectiveness of the mud motor and/or result in failure of the mud motor.

SUMMARY

In one embodiment, a drilling system includes a drill string, a plurality of sensors, and a computing system. The drill string includes a downhole motor. The sensors are coupled to the drill string. The computing system is coupled to the sensors. The computing system is configured to compute, based on measurements provided by the sensors, a motor stall index, and to determine, by comparing the motor stall index to a motor stall threshold, whether the downhole motor has stalled. The computing system is also configured to, responsive to a determination that the downhole motor has stalled, adjust operation of the drill string to restart the downhole motor.

In another embodiment, a method for operating a drilling system includes receiving measurements from a plurality of sensors coupled to a drill string. The drill string includes a downhole motor to turn a drill bit. A motor stall index is computed, by a computing system coupled to the drill string and the sensors. Whether the downhole motor has stalled is determined, by the computing system, by comparing the motor stall index to a motor stall threshold. Operation of the drill string is adjusted, by the computing system, to restart the downhole motor responsive to determining that the downhole motor has stalled.

In yet another embodiment, a non-transitory computer-readable medium is encoded with instructions that when executed by a processor cause the processor to receive measurements from a plurality of sensors coupled to a drill string, and to compute a motor stall index based on the measurements. The drill string comprises a downhole motor to turn a drill bit. The instructions also cause the processor to determine whether the downhole motor has stalled by comparing the motor stall index to a motor stall threshold, and to adjust operation of the drill string to restart the downhole motor responsive to determining that the downhole motor has stalled.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
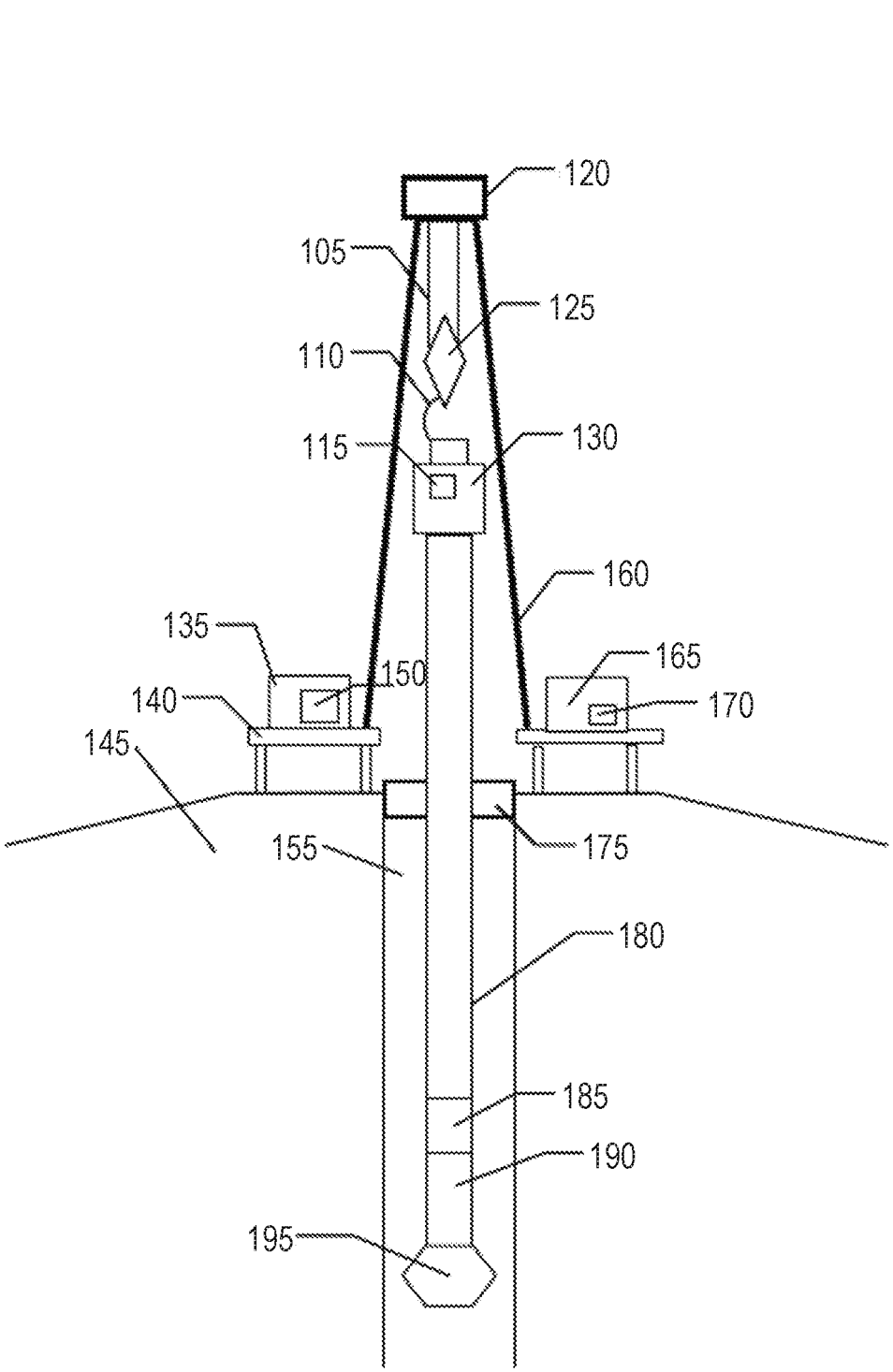
FIG. 1 is a schematic diagram of a drilling system for drilling a borehole in a subsurface earthen formation in accordance with the present disclosure.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," "close," and the like mean within 10% (i.e., plus or minus 10%) of the recited value. Thus, for example, a recited angle of "about 80 degrees" refers to an angle ranging from 72 degrees to 88 degrees.

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

The following abbreviations and initialisms apply:

BHA: bottomhole assembly
CPU: central processing unit
GPU: graphics processing unit
GUI: graphic user interface
IP: Internet Protocol
LAN: local area network
NOVOS™: National Oilwell Varco OS
OS: operating system
psi: pounds per square inch
RF: radio frequency
ROC: rate of change
RPM: revolutions per minute
SP: set point
SPP: standpipe pressure
TCP: Transmission Control Protocol.

As previously described, damage to the elastomeric material of the stator of a mud motor can result in reduced performance of the mud motor and/or failure of the mud motor. The abrupt and/or inadvertent stall of a mud motor during drilling operations can damage the elastomeric material. Consequently, it is desirable to avoid stalls. In many conventional drilling operations, motor stalls are not identified until well after the fact such as when tripping the drillstring out of the borehole. In addition, most conventional drilling operations do not provide a means to predict or detect motor stalls as humans often control and monitor drilling operations but may not be able to simultaneously consider all the factors potentially contributing to motor stall, may respond slower than desired to a possible motor stall, may suffer from inconsistency or errors in assessing potential motor stalls, or combinations thereof. Accordingly, disclosed herein are embodiments for downhole motor stall detection, correction, and prevention. The embodiments provide for detection of downhole motor stalls by observing data in real time. In this context, the phrase "real time" may indicate with little delay and in a manner to provide for adequate correction. Alternatively, the phrase "real time" may indicate that components communicate data upon generation of that data. For instance, the embodiments provide for observing data within 30 seconds of their availability. If a motor stall occurs, then correction and prevention of future stalls may be performed automatically. The embodiments therefore offer the potential to reduce a likelihood of motor stalls or near motor stalls.

FIG. 1 is a schematic diagram of a drilling system 100 for drilling a borehole 155 in a subsurface earthen formation 145. The drilling system 100 includes a derrick 160 mounted on a rig floor 140. A crown block 120 is mounted at a top of the derrick 160, and a traveling block 125 hangs from the crown block 120 by means of a cable 105. One end of the cable 105 is connected to drawworks 135, which is a reeling device that adjusts a length of the cable 105 so that the traveling block 125 moves up and down the derrick 160. A top drive 130 rests on a hook 110 attached to a bottom of the traveling block 125. The top drive 130 is coupled to a top of a drill string 180, which extends through a wellhead 175 and into the borehole 155 below the rig floor 140. The top drive 130 rotates the drill string 180 inside the borehole 155 as a bit 195 drills the borehole 155.

A BHA includes a bottom portion of the drill string 180, as well as a sensor 185, a motor 190, and the bit 195. The motor 190 runs the bit 195. The drilling system 100 further includes additional sensors 115, 150, 170 and a computing system 165 located above the rig floor 140. Together, the sensors 115, 150, 170, 185 make up a sensor system that monitors drilling components of the drilling system 100, generates data related to operation of the components, and transmits that data to the computing system 165. The sensors 115, 150, 170, 185 do so in a wired or wireless manner. The computing system 165 collects the data and analyzes the data in order to instruct further operation of the drilling system 100. Though the computing system 165 is shown in proximity to the other components of the drilling system 100, the computing system 165 may be located remotely from the other components.

When the drilling system 100 is in operation, it may undergo large pressure spikes, which may cause the motor 190 to stall. There may be no opportunity to prevent the motor 190 from stalling. In conventional operation, workers then inspect the drilling system 100, identify data associated with the drilling system 100 when the motor stall occurred, and provide that data to manufacturers and/or operators of the drilling system components in order to prevent future stalling. The workers must also manually remove the bit 195. Even if the motor 190 does not stall, large pressure spikes may degrade the motor 190 and other components. The drilling system 100 observes data of the drilling system 100 in real time and automatically adjusts operation in a manner that reduces a likelihood of motor stalls or near motor stalls.

Figure 2:
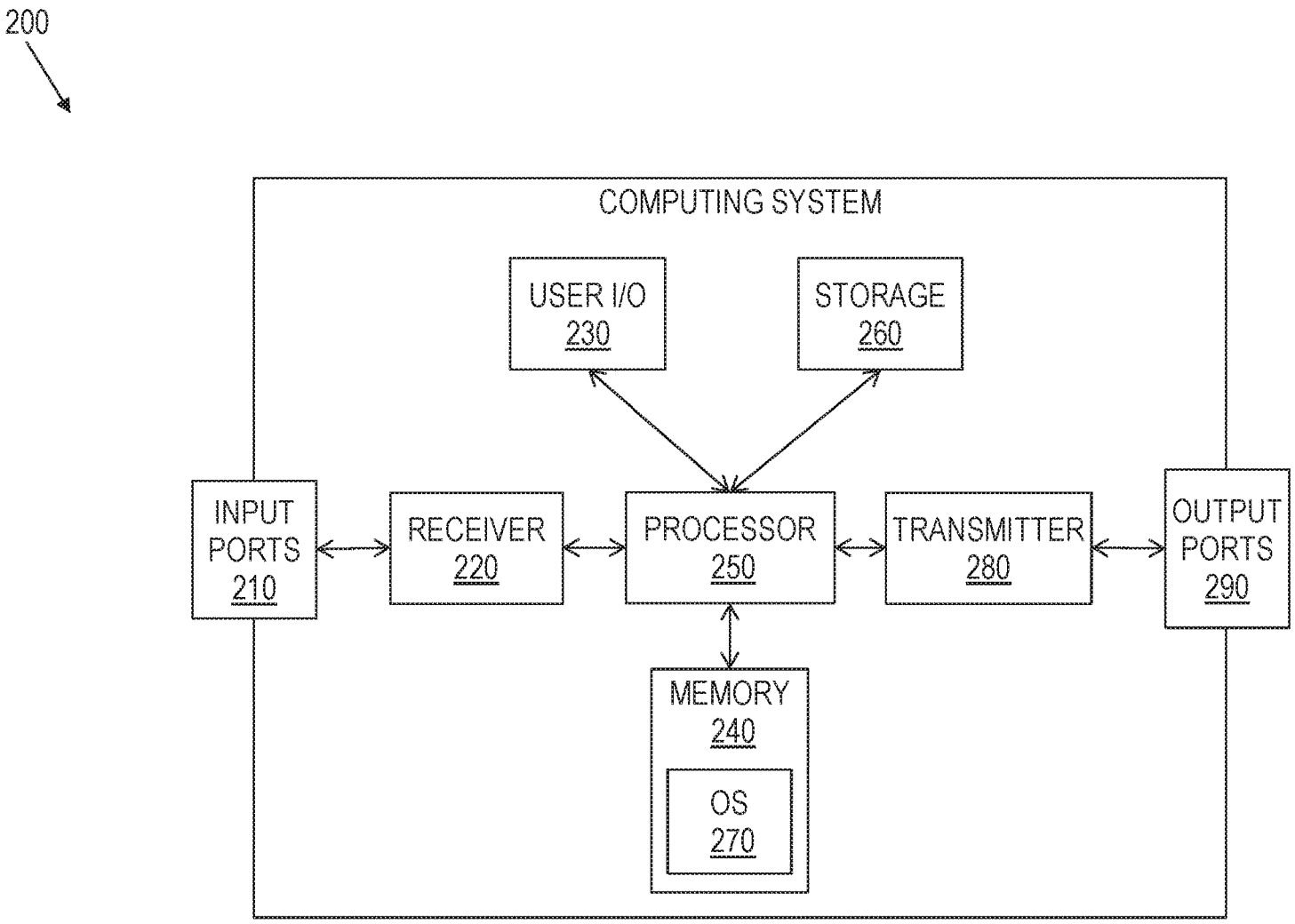
FIG. 2 is a schematic diagram of a computing system for operating the drilling system of FIG. 1 in accordance with the present disclosure.

FIG. 2 is a schematic diagram of a computing system 200 in accordance with the present disclosure. The computing system 200 may be an implementation of the computing system 165 in the drilling system 100 in FIG. 1. The computing system 200 includes input ports 210, a receiver 220, a user I/O device 230, a memory 240, a processor 250, a storage 260, an OS 270, a transmitter 280, and output ports 290. The input ports 210 input data from, for instance, the sensor system in the drilling system 100. The receiver 220 processes data from the input ports 210 for presentation to the processor 250. For instance, the receiver 220 converts data from the input ports 210 from RF signals to digital electrical signals. The user I/O device 230 receives data from the processor 250 and displays the data in a graphical manner for presentation to a user. For example, the user I/O device 230 may include a liquid crystal or other display for presenting data to a user in the form of a GUI. The user I/O device 230 may also include a touch screen that receives feedback from the user. The memory 240 stores programs for execution by the processor 250. The programs stored in the memory 240 may include instructions and data that the processor 250 reads during execution of the programs.

The processor 250 may include a general-purpose microprocessor, a digital signal processor, a GPU and/or any other device that executes instructions retrieved from the memory 240 to provide the functionality disclosed herein. The storage 260 is a tape drive, magnetic disk, a solid-state drive, or another medium suitable for storing data or programs for use by the processor 250.

The OS 270 may be stored in and/or executed from the memory 240. The OS 270 may be NOVOS™ or another OS suitable for analyzing data from the sensor system and generating instructions to operate the drilling system 100 based on that data or otherwise. The instructions from the OS 270 reduce the number of manual button selections made by workers. The OS 270 may be stored in the memory 240, and the processor 250 executes the OS 270. The OS 270 is described further below. When the OS 270 is described as performing a function, an application in or associated with the OS 270 may perform the function. The transmitter 280 processes data from the processor 250 for presentation to external components. For instance, the transmitter 280 converts data from the processor 250 from digital electrical signals to RF signals. Finally, the output ports 290 output data from the transmitter 280 to, for instance, components of the drilling system 100.

Figure 3:
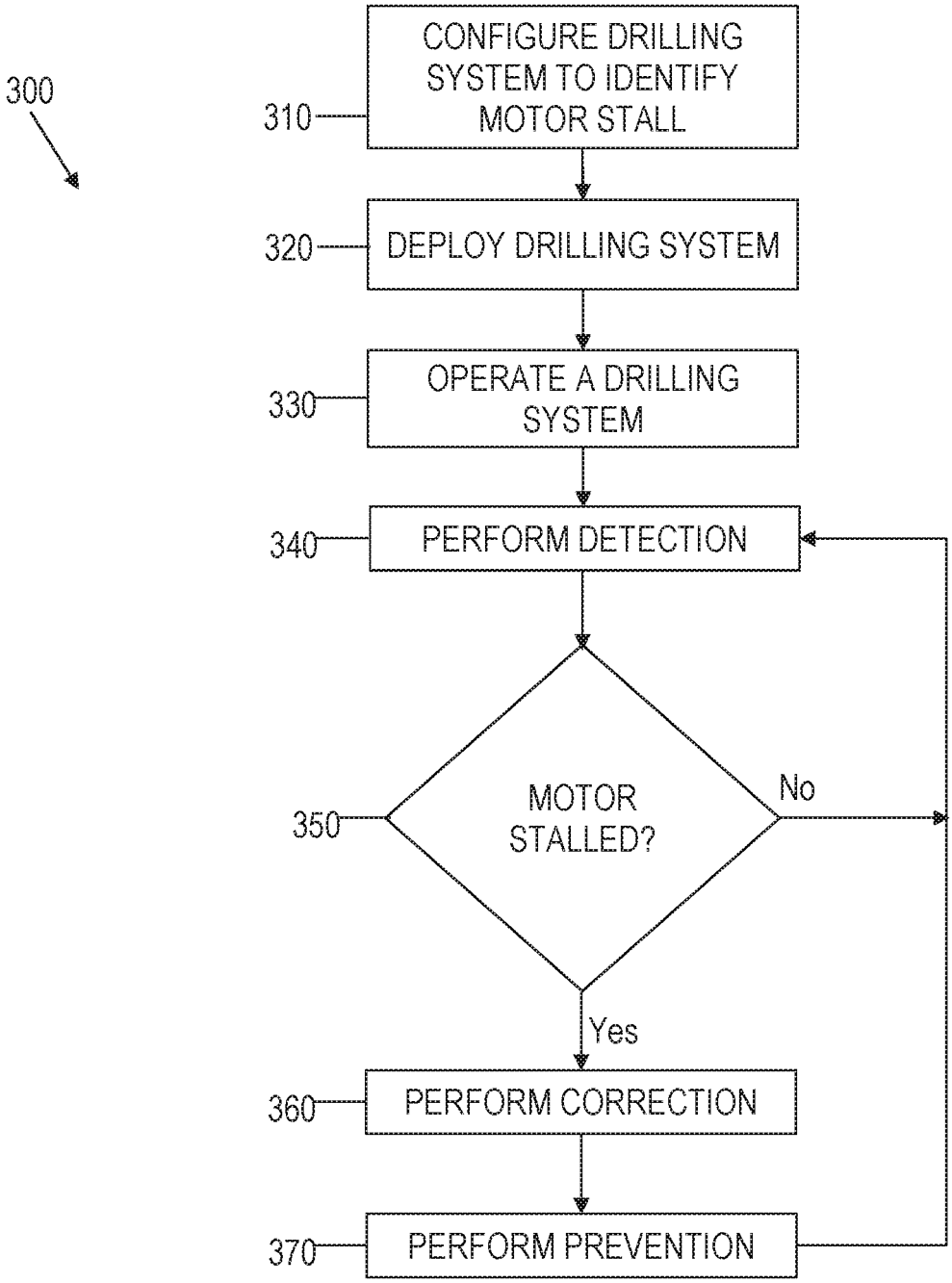
FIG. 3 is a flowchart illustrating a method of operating a drilling system with downhole motor stall detection, correction, and prevention in accordance with the present disclosure.

FIG. 3 is a flowchart illustrating a method 300 of operating a drilling system with downhole motor stall detection, correction, and prevention according to an embodiment of the disclosure. Though depicted sequentially as a matter of convenience, at least some of the actions shown can be performed in a different order and/or performed in parallel. Additionally, some implementations may perform only some of the actions shown. The drilling system 100 performs at least a portion of the method 300. The method 300 may be a geographically local method, meaning it is unique to the drilling system 100, including the subsurface earthen formation 145, or to a well area. The computing system 165 may execute at least a portion of the method 300 in real time and automatically.

At step 310, the OS 270, an application executed by the OS 270, or an application otherwise executed by the computing system 165 is configured to identify a stall of the motor 190, and to detect the operational conditions in the drilling system 100 that are indicative of a stall in the motor 190. In some implementations of the drilling system 100, configuring the OS 270 to detect a stall of the motor 190 includes training a machine learning model to detect a stall of the motor 190, and to detect the operational conditions in the drilling system 100 that are indicative of a stall in the motor 190. Information regarding training of a machine learning model to identify a stall in the motor 190 is provided in FIG. 10 and corresponding explanatory text.

At step 320, the OS 270, and a machine learning model trained to identify a stall in the motor 190, is deployed at a wellsite as part of the drilling system 100.

At step 330, the drilling system 100 is operated. For instance, the OS 270 automatically instructs the drilling system 100 to operate. Alternatively, a worker manually initiates the drilling system 100. Operation of the drilling system 100 includes actuating the motor 190 to rotate the bit 195 and remove material from the subsurface earthen formation 145.

At step 340, detection is performed. For instance, the OS 270 obtains, from the sensor system, data in the form of monitoring parameters. In implementations including a machine learning model to detect a stall in the motor 190, the OS 270 provides the monitoring parameters to the machine learning model. OS 270 detects whether a motor stall has occurred based on how those monitoring parameters change over time. The OS 270 does so in a continuous manner or at set intervals. In some embodiments, the monitoring parameters include a measurement of RPM, a measurement of surface torque, a measurement of flow rate, and a measurement of SPP. The RPM is a rotational velocity of the motor 190 and is measured in a number of rotations of the motor 190 per minute. The surface torque is a rotational force the top drive 130, a rotary table, or the motor 190 applies to the bit 195 and is measured in foot-pounds, joules, or Newton-meters. The flow rate is a rate of flow of drilling fluid in the bit 195 and may be measured in gallon per minute. The SPP is a total pressure loss in the drilling system 100 that occurs due to fluid friction and may be measured in pounds per square inch (PSI).

At decision 350, whether the detection indicates that the motor 190 is stalled is determined. If the motor 190 is not stalled, then the method 300 returns to step 340. If the motor 190 is stalled, then the method 300 proceeds to step 360.

To determine whether the motor 190 is stalled, the OS 270 may determine whether the following inequality is satisfied:

$$\text{motor stall index} > \text{motor stall threshold}. \tag{1}$$

In inequality (1), the motor stall threshold is determined by analysis of identified motor stalls in the training process, and may change based on variation in operating conditions that cause the motor 190 to stall. The motor stall index is represented by the following formula:

$$\text{motor stall index} = \alpha*[(\text{RPM index})*(\text{surface torque index})] + \beta*[(\text{flow rate index})*(\text{SPP index})] \tag{2}$$

where:

$0 \leq \text{motor stall index} \leq 1$;

$0 \leq \alpha \leq 1$;

$0 \leq \beta \leq 1$; and $\alpha + \beta = 1$.

$\alpha$ and $\beta$ are coefficients that control the degree of torque and SPP influence on motor stall index, and guarantee the motor stall index is between 0 and 1. The values of $\alpha$ and $\beta$ may be varied based on operational conditions (such as: composition of the subsurface earthen formation 145 being drilled, whether the top drive 130 is rotating the drill string 180, etc.). For example, if the top drive 130 is not rotating the drill string 180, then the value of $\alpha$ may be reduced to decrease the contribution of torque to the motor stall index, and the value of $\beta$ may be increased to increase the influence of SPP on the motor stall index.

The RPM index, the surface torque index, the flow rate index, and the SPP index are performance indices that compare performance of an activity of the drilling system 100 during operation at step 330 to reference performance of the activity. The reference performance may be of the drilling system 100 in the subsurface earthen formation 145 during a period prior to step 330, the drilling system 100 in a different subsurface earthen formation, or a different drilling system. As an example, the RPM index, the surface torque index, the flow rate index, and the SPP index use the following general formula:

$$\text{index} = \frac{1}{1 + e^{-k(-ROC+SP)}} \tag{3}$$

where:

index may be the RPM index, the surface torque index, the flow rate index, or the SPP index;

e is a mathematical constant that is approximately equal to 2.71828;

k is a constant learned during a training process;

ROC is computed by the computing system 165 based on the received measurements, and is a measure of how much the RPM, the surface torque, the flow rate, or the SPP has changed over a given period of time and is in constant units; and SP is a constant threshold, determined in the training process, that varies depending on the index and is used to scale units to a range between 0 and 1.

The RPM and the flow rate are system inputs because the OS 270 modifies them to achieve desired behavior during operation. The surface torque and the SPP are system outputs because the OS 270 monitors them as the OS 270 modifies the RPM and the flow rate. Equation (2) correlates how the system inputs affect detection of a motor stall or a near motor stall by monitoring the corresponding system outputs. If the RPM and the flow rate are stable, then the surface torque and the SPP should also be stable under normal conditions. However, if the RPM and the flow rate are stable, but the surface torque and the SPP begin to move towards a limit of safe operation, then a motor stall may occur.

Equations (2) and (3) correlate the RPM, the surface torque, the flow rate, and the SPP in a unit-less manner, which is helpful for analyzing scenarios where units and thresholds are constantly changing. For example, the RPM of a first rig is 30-35 and the RPM of a second rig is 100-150. A change of 2 RPM has a bigger impact on the first rig than it does on the second rig. Moreover, the resulting surface torque will be different for the first rig and the second rig. In order to implement machine learning, it is important to normalize those differences. Equations (2) and (3) provide such normalization by using indices instead of raw data.

Both the RPM index and the flow rate index may be referred to as penalty terms in equation (2). The RPM index increases or is close to 1 when the RPM is stable or changes within the RPM threshold, and the RPM index decreases or is close to 0 when the RPM changes beyond the RPM threshold. The surface torque index increases when the surface torque is above the surface torque threshold and is otherwise 0. When the RPM index is relatively smaller, the surface torque has less of an effect on whether a motor stall has occurred because a change in RPM typically corresponds to a change in surface torque. Similarly, the flow rate index increases or is close to 1 when the flow rate is stable or changes within the flow rate threshold, and the flow rate index decreases or is close to 0 when the flow rate changes beyond the flow rate threshold. The SPP index increases when the SPP is above the SPP threshold and is otherwise 0. When the flow rate index is relatively smaller, the SPP has less of an effect on whether a motor stall has occurred because a change in the flow rate typically corresponds to a change in the SPP.

At least five cases may occur. In a first case, the RPM index, the surface torque index, the flow rate index, and the SPP index remain the same or undergo negligible changes, so the motor stall index remains the same, thus indicating no motor stall has occurred. In a second case, the RPM index and the flow rate index remain the same or undergo negligible changes, and the surface torque index and the SPP index increase, so the motor stall index increases, thus indicating a motor stall has occurred. In a third case, the RPM index either increases or decreases, the flow rate index remains the same or undergoes a negligible change, and the surface torque index and the SPP index increase, so the motor stall index decreases, thus indicating no motor stall has occurred. In a fourth case, the RPM index remains the same or undergoes a negligible change, the flow rate index either increases or decreases, and the surface torque index and the SPP index increase, so the motor stall index decreases, thus indicating no motor stall has occurred. In a fifth case, the RPM index and the flow rate index either increase or decrease, and the surface torque index and the SPP index increase, so the motor stall index decreases, thus indicating no motor stall has occurred.

At step 360, the motor 190 is stalled, and correction is performed to restart the motor 190. For instance, the OS 270 instructs the user I/O device 230 to display a warning that motor stall has occurred and that the drilling system 100 will enter a motor stall correction procedure. The OS 270 may instruct the top drive 130 to decrease its RPM to 0, and the OS 270 may instruct the drilling system 100 to decrease the flow rate or turn the mud pumps off. The drilling system 100 may then perform a control unwind of top drive torque until trapped torque is below a threshold. The drilling system 100 may then hoist the bit off bottom and perform a control unwind of top drive torque if necessary. In some implementations of the drilling system 100, the computing system 165 may implement multiple simultaneous actions to correct a stall in the motor 190. For example, the computing system 165 may simultaneously control the drawworks 135 to reduce weight on bit, control (e.g., reverse rotation of) the top drive 130 (or rotary table) to reduce torque in the drill string 180, and control a mud pump reduce fluid pressure in the drill string 180.

At step 370, the OS 270 takes action to prevent the motor 190 from stalling in the future. For example, the OS 270 instructs components of the drilling system 100 to change their behavior in order to reduce the likelihood of a motor stall or a near motor stall occurring in the future. Actions taken by the OS 270 to prevent future stalls of the motor 190 may include reducing the weight on bit by a predetermined amount (e.g., a predetermined percentage of the weight on bit at the time the motor 190 stalled), reducing the flow rate of the drilling fluid by a predetermined amount (e.g., a predetermined percentage of the drilling fluid flow rate at the time the motor 190 stalled), and/or changing another drilling parameter that affects operation of the motor 190.

The OS 270 or an application of the OS 270 may perform steps 340, 360, and 370 and execute decision 350 as part of an algorithm stored in the memory 240.

Figure 4:
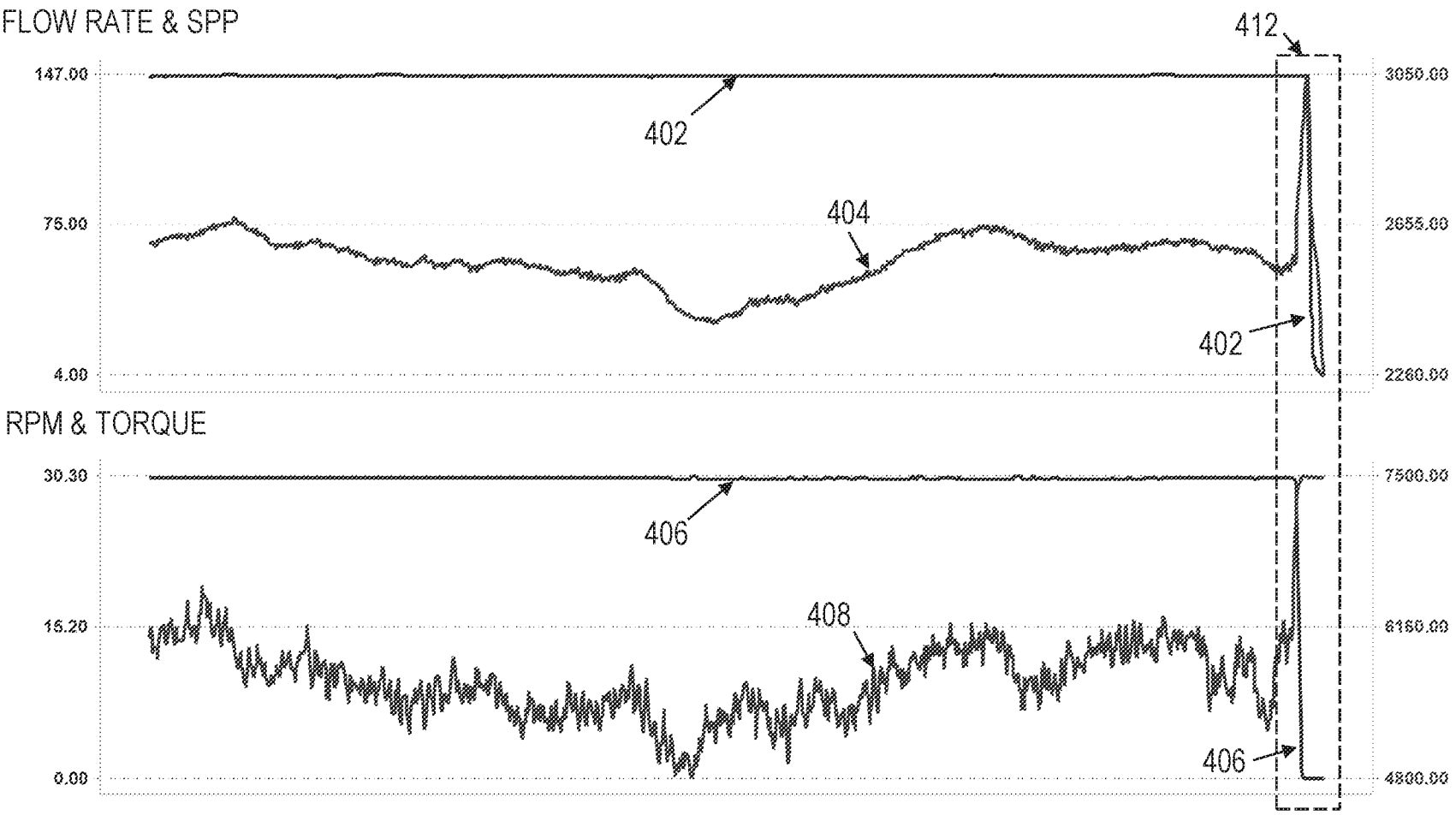
FIGS. 4-9 show examples of RPM, flow rate, torque and SPP measurement values and indices used in the drilling system 100 to identify a stall or near stall of the downhole motor.

FIGS. 4-9 show examples of the RPM, flow rate, torque and SPP measurement values and indices used in the drilling system 100 to identify a stall or near stall of the motor 190. FIG. 4 shows flow rate 402, SPP 404, RPM 406, and torque 408 produced by operation of the drilling system 100 under conditions that may indicate a stall of the motor 190. In interval 412, SPP 404 and torque 408 increase substantially, and flow rate 402 and RPM 406 decrease substantially, which may indicate that the motor 190 has stalled.

Figure 5:
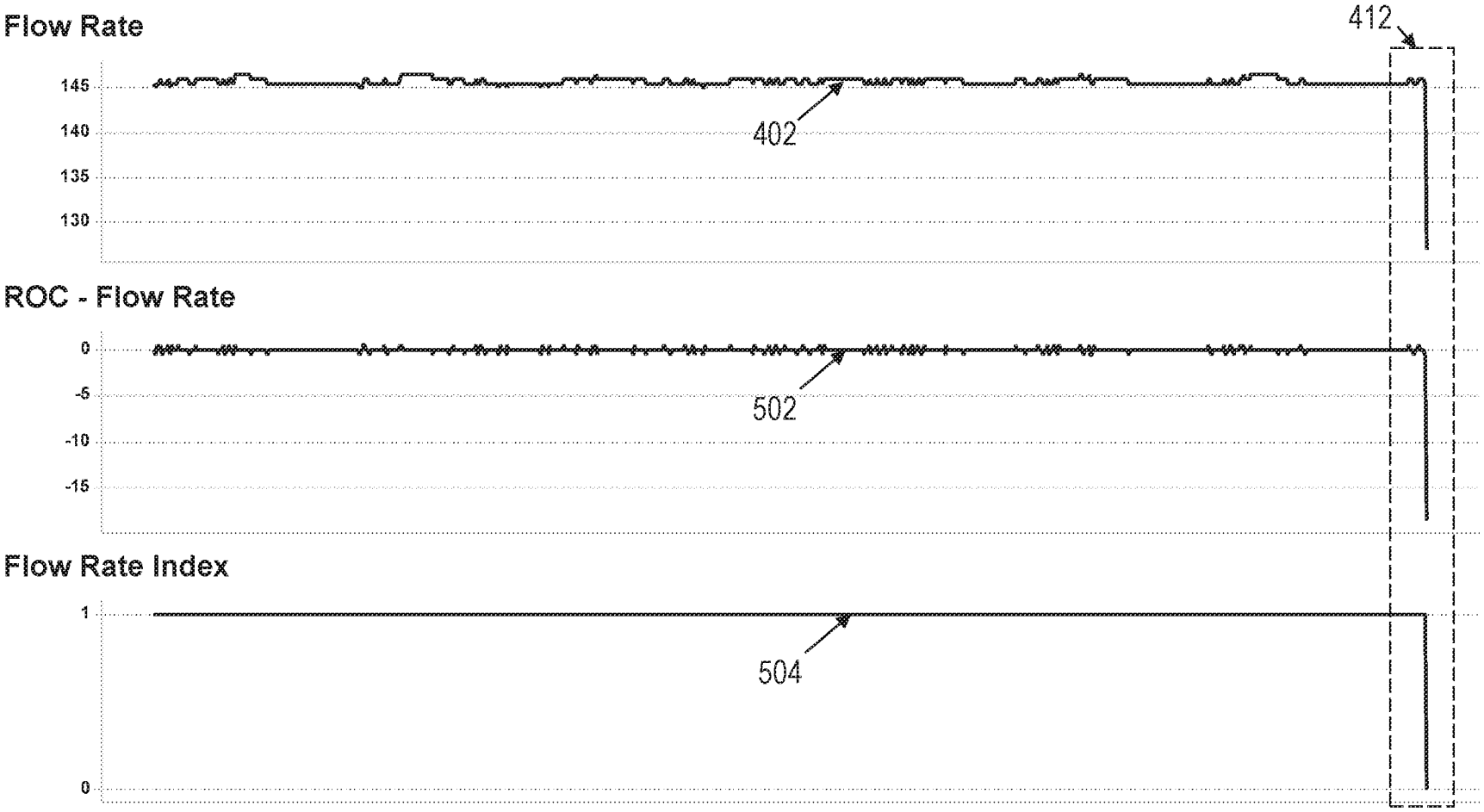

FIG. 5 shows the flow rate 402, the ROC 502 of the flow rate 402, and the flow rate index 504 derived from the ROC 502 using equation (3). The flow rate index 504 transitions from 1 to 0 as the ROC 502 of the flow rate 402 changes substantially in interval 412.

Figure 6:
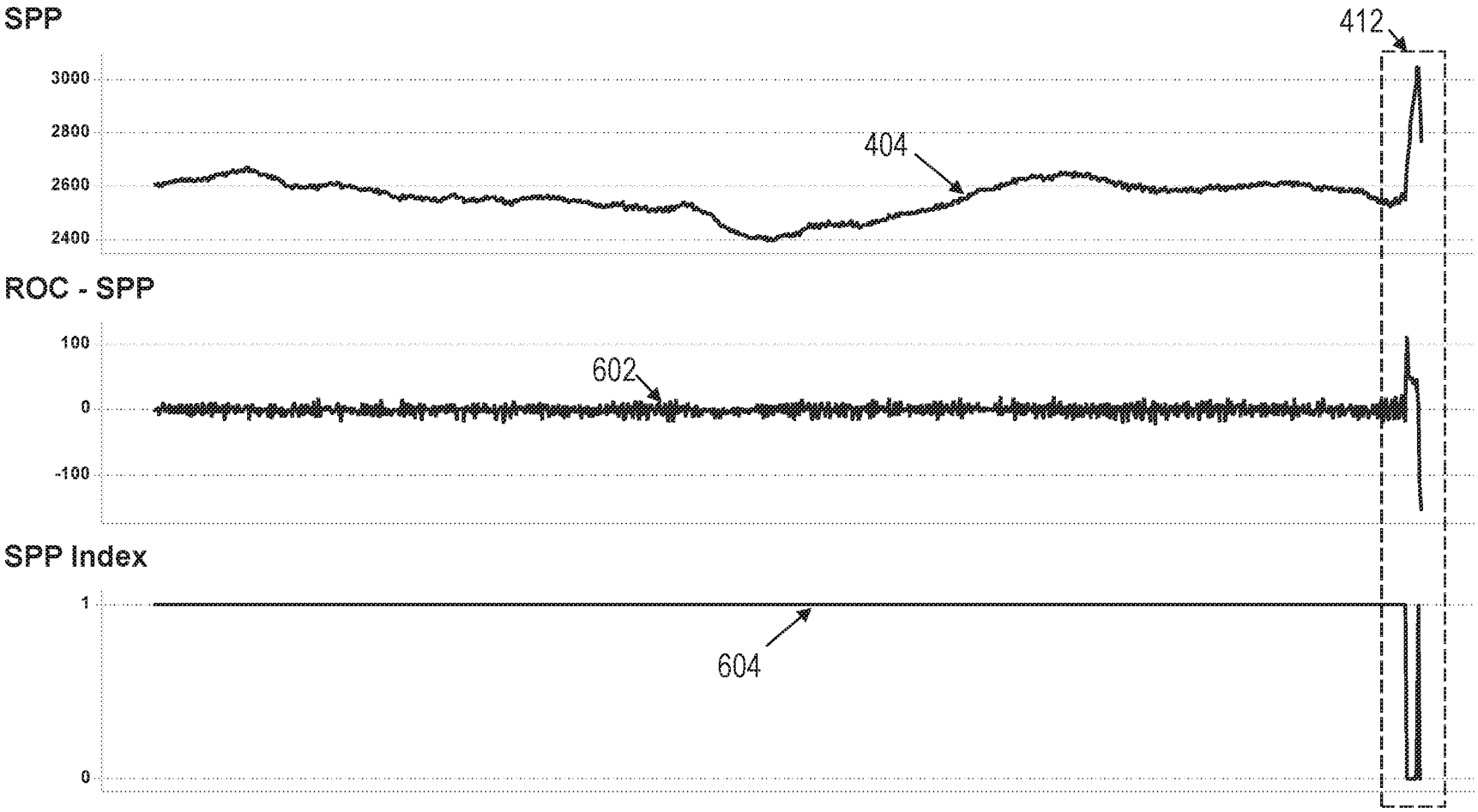

FIG. 6 shows the SPP 404, the ROC 602 of the SPP 404, and the SPP index 604 derived from the ROC 602 using equation (3). The SPP index 604 transitions from 1 to 0 as the ROC 602 of the SPP 604 increases substantially in interval 412.

Figure 7:
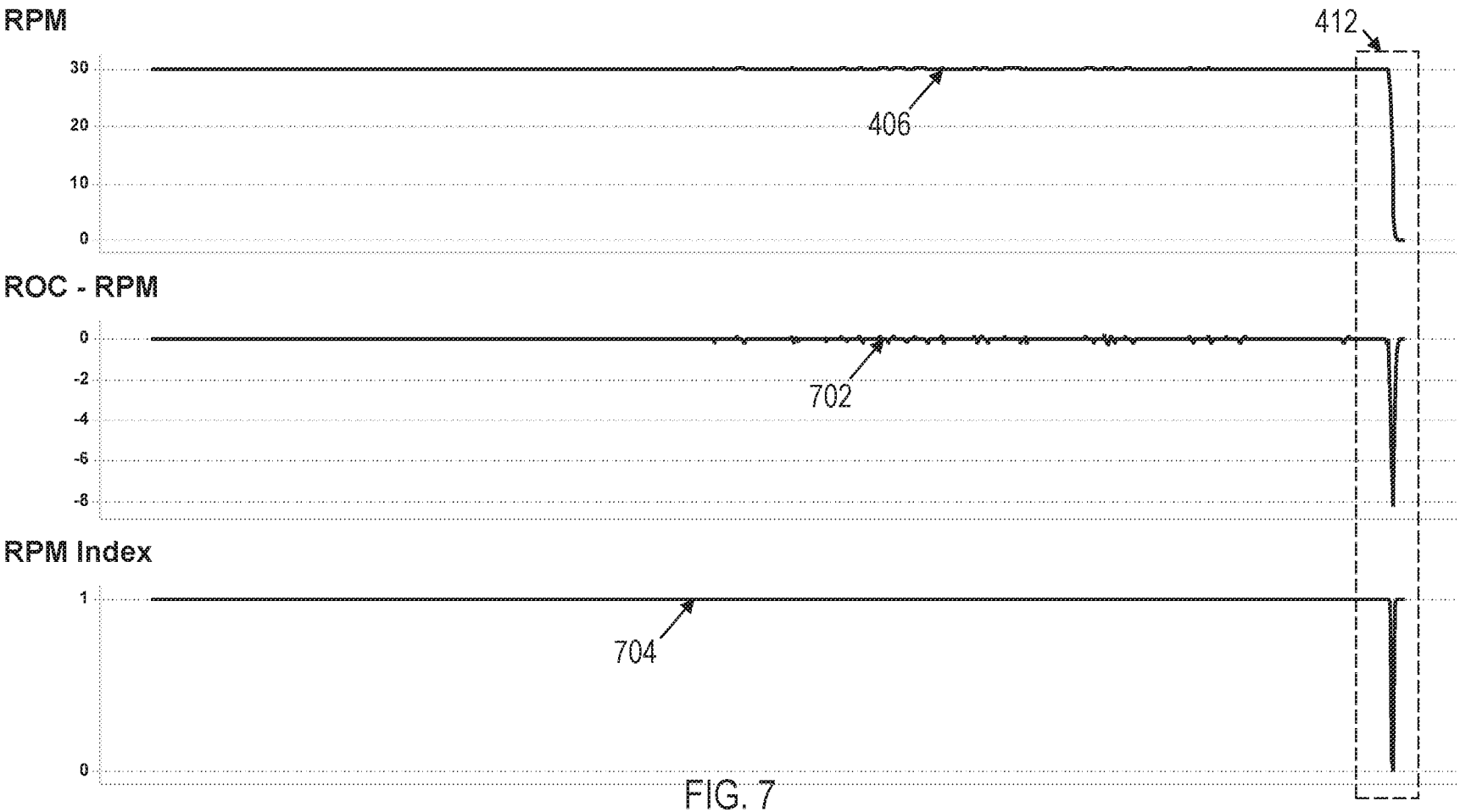

FIG. 7 shows the RPM 406, the ROC 702 of the RPM 406, and the RPM index 704 derived from the ROC 702 using equation (3). The RPM index 704 transitions from 1 to 0 as the ROC 702 of the RPM 406 changes substantially in interval 412.

Figure 8:
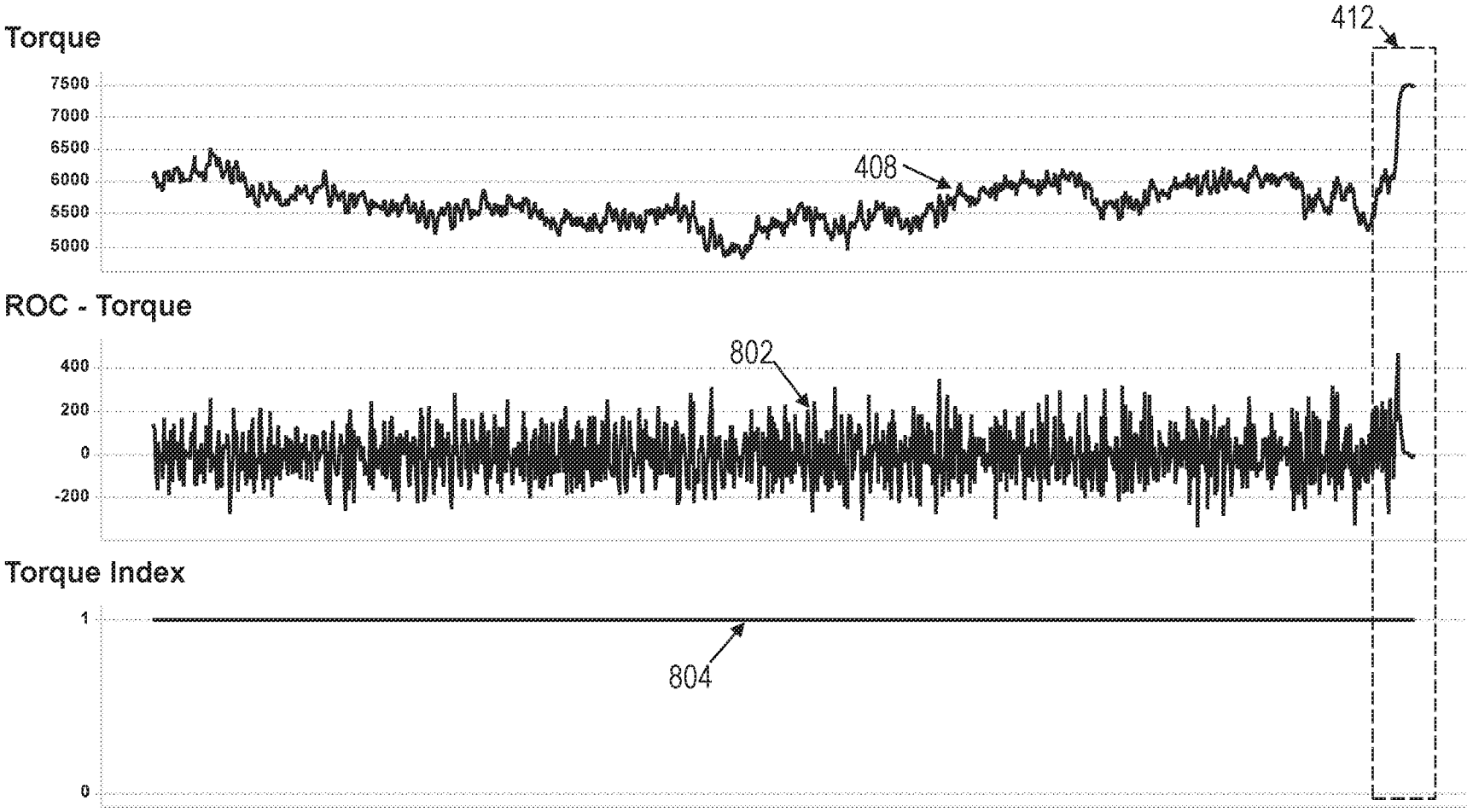

FIG. 8 shows the torque 408, the ROC 802 of the torque 408, and the torque index 804 derived from the ROC 802 using equation (3). The torque index 804 does not change in interval 412.

Figure 9:
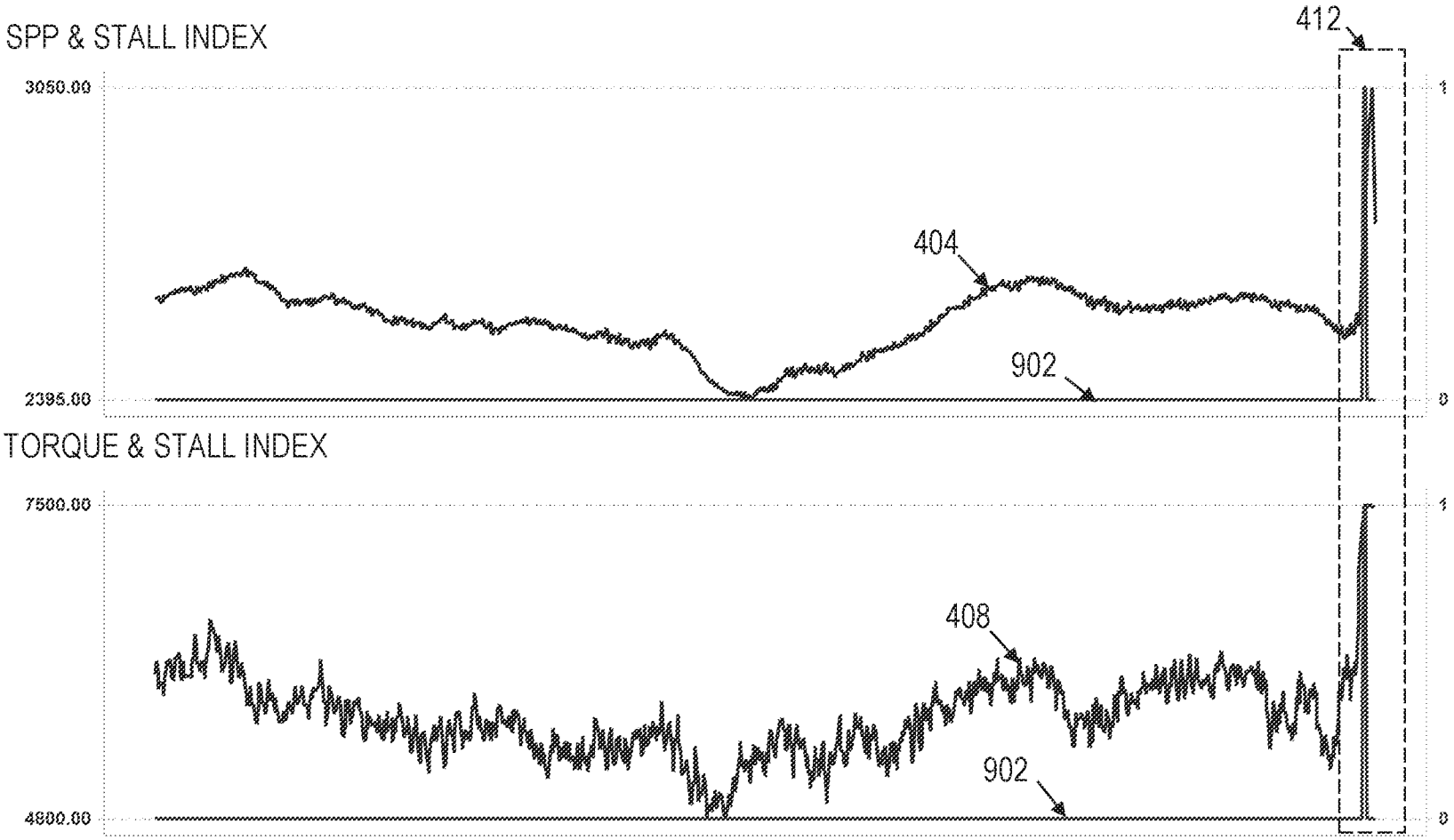

FIG. 9 shows the SPP 404, the torque 408, and the motor stall index 902. The motor stall index 902 is derived from the flow rate index 504, the SPP index 604, the RPM index 704, and the torque index 804 using equation (2). Given the values of the flow rate index 504, the SPP index 604, the RPM index 704, and the torque index 804 illustrated in FIGS. 5-8, the motor stall index 902 transitions from 0 to 1 in the interval 412 indicating that the motor 190 may be stalled. Given different torque, SPP, flow rate, and RPM measurements, the motor stall index may transition to a different value, and comparison to one or more threshold values may indicate that the motor 190 is stalled or may be close to stalling.

Figure 10:
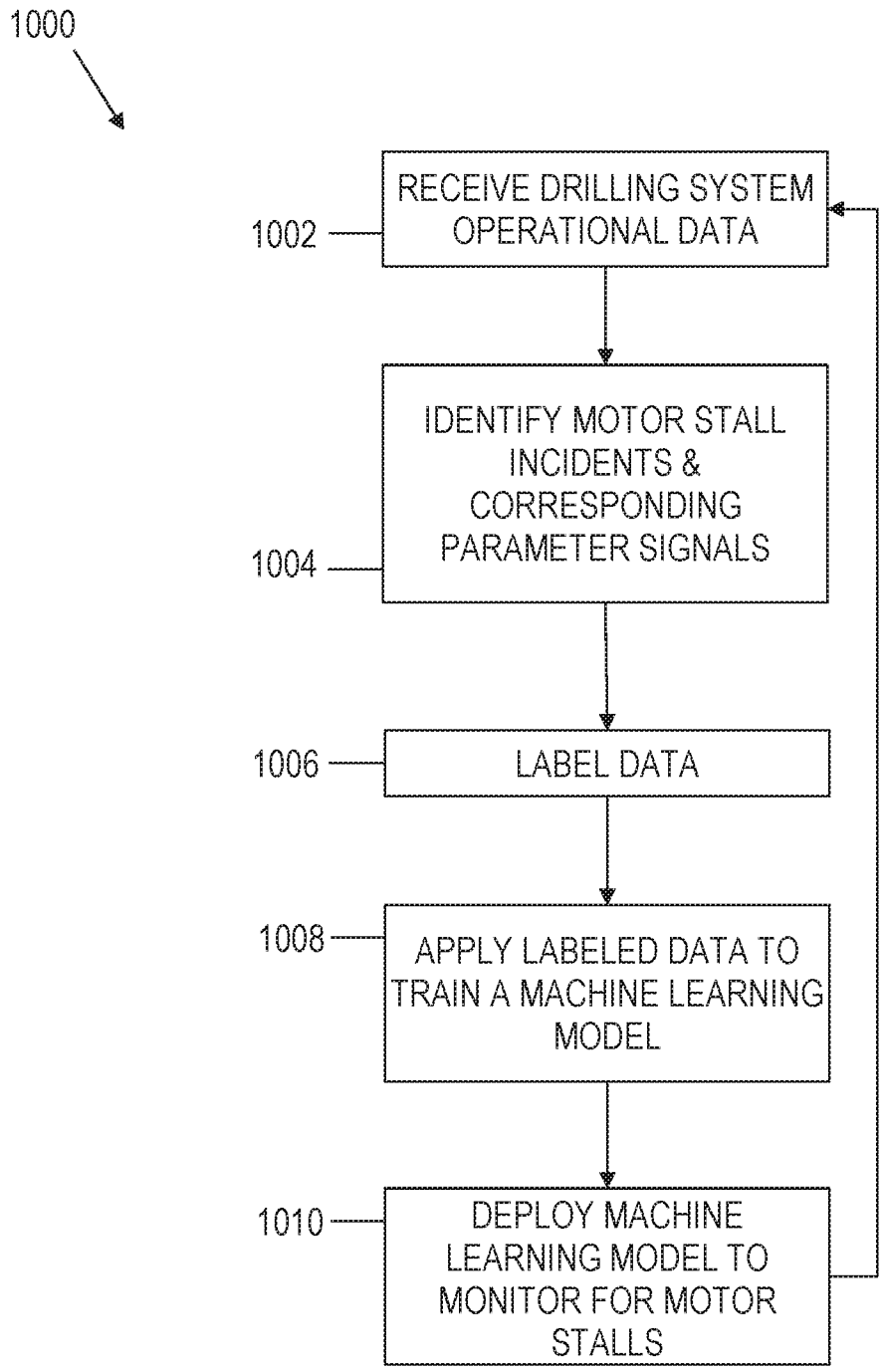
FIG. 10 is a flowchart illustrating a method for machine learning in accordance with the present disclosure.

FIG. 10 is a flowchart illustrating a generalized method 1000 of machine learning according to an embodiment of the disclosure. Though depicted sequentially as a matter of convenience, at least some of the actions shown can be performed in a different order and/or performed in parallel. Additionally, some implementations may perform only some of the actions shown. The OS 270 or an application of the OS 270 may perform the method 1000 as part of an algorithm stored in the memory 240.

At step 1002, drilling system operational data is received. The operational data may include parameters of the motor 190 (e.g., recommended operational pressure, maximum recommended pressure, etc.), and measurements of RPM, surface torque, flow rate, and SPP acquired while drilling one or more wells. For example, the operational data may include measurements of RPM, surface torque, flow rate, and SPP acquired while drilling many wells prior to initiation of drilling using the drilling system 100, and/or the operational data may include measurements of RPM, surface torque, flow rate, and SPP acquired while drilling the borehole 155.

At step 1004, the operational data is analyzed to identify motor stall incidents and/or near motor stall incidents, and the operational conditions leading to or precipitating the stall or near stall incidents. For example, increases in torque and/or increases in SPP, decreases in RPM, decreases in flow rate indicative of motor stall or near motor stall are identified. Features of the operational data (i.e., features of the measurements), such as ROC of the measurements at or about the time of a motor stall or near motor stall are determined.

In step 1006, the operational data is labeled identify motor stalls, near motor stalls, and measurement parameters relevant thereto.

In step 1008, the labeled operational data is applied to train a machine learning model to identify motor stalls and/or near motor stalls. The training includes applying the labeled operational data to determine values for α and β of equation (2), a value of SP for RPM index, flow rate index, torque index and SPP index for use in equation (3), and threshold value for comparison to the motor stall index in inequality (1). For example, SP may be determined as a threshold value of an ROC of a measurement indicating instability in the measurement, and α and β may be determined as coefficients of relative importance of SPP and torque to identifying a stall of the motor 190.

The step 1010, the trained machine learning model is deployed in the drilling system 100, and executed to identify motor stalls. Deployment of a trained machine learning model may include providing the values of α, β, and SP determined in step 1008 to the computing system 165 for storage in memory and use in equations (2) and (3) to compute the RPM index, flow rate index, torque index, SPP index, and motor stall index in the method 300.

The steps of the method 1000 may be repeated as needed to update the training of the machine learning model and improve detection of motor stalls and near motor stalls in the drilling system 100. For example, the method 100 may be repeated as the drilling system 100 is drilling the borehole 155, using measurements collected during the drilling, to improve detection of motor stalls.

Figure 11:
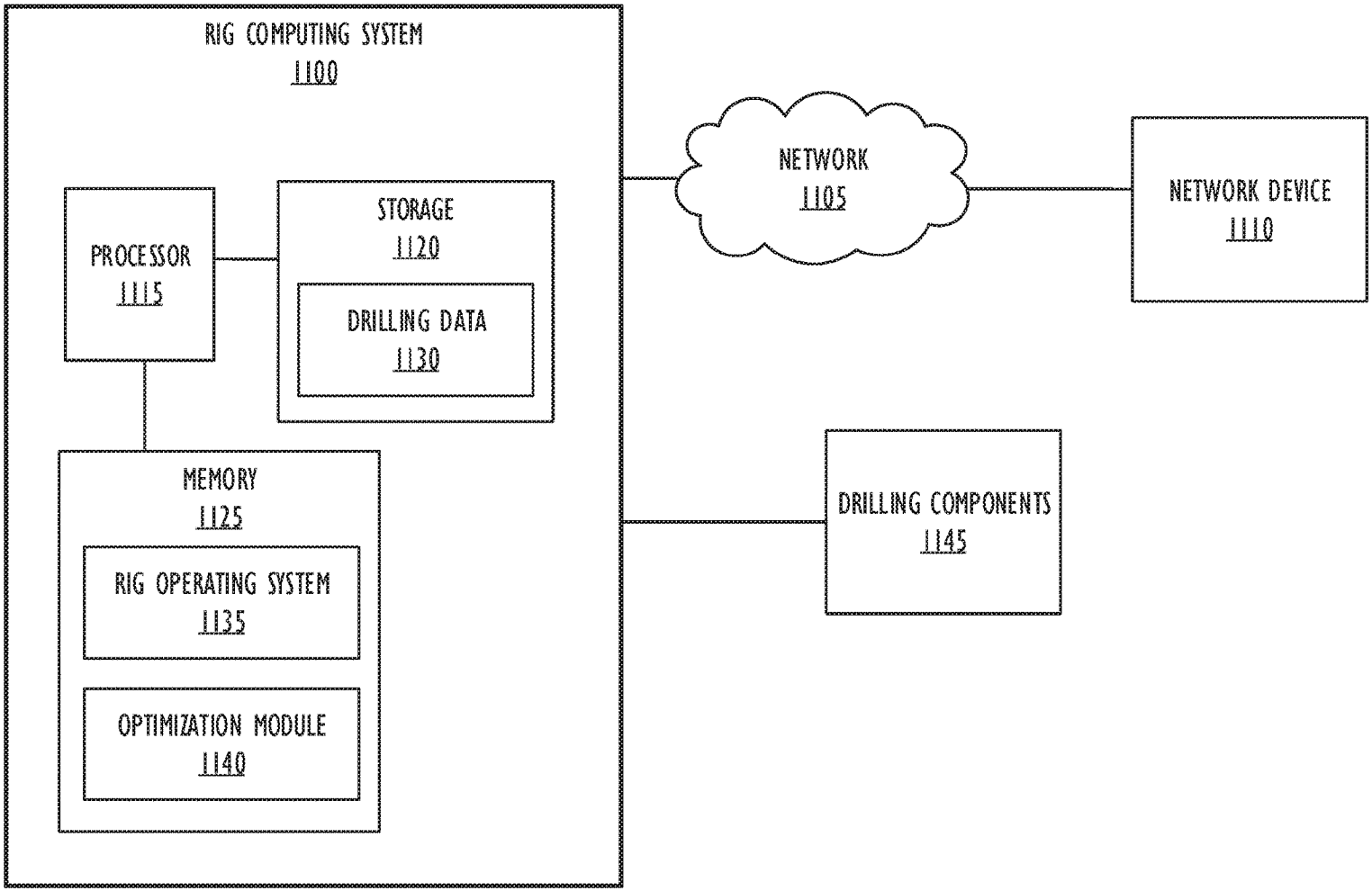
FIG. 11 is a system diagram illustrating a drilling rig software system for automated drilling in accordance with the present disclosure.

FIG. 11 depicts a system diagram illustrating a drilling rig software system for automated drilling. FIG. 11 is described in international patent application number PCT/US17/54446 titled "Drilling Rig Software System Controls Rig Equipment to Automate Routine Drilling Processes" filed on Sep. 29, 2017 by National Oilwell Varco, L.P. ("'xxx Application"), which is incorporated by reference. FIG. 11 includes a rig computing system 1100 connected to one or more network devices 1110 across a network 1105. Rig computing system 1100 may be, for example, a detailed version of computing system 165 of FIG. 1. Network device 1110 may include any kind of device accessible across network 1105, with which rig computing system 1100 may communicate. For example, network device 1110 may be an additional rig computing system, a server, or a remote computer. Network 1105 may include many different types of computer networks available today, such as the Internet, a corporate network, a LAN, or a personal network such as those over a Bluetooth connection. Each of these networks can contain wired or wireless programmable devices and operate using any number of network protocols (e.g., TCP/IP). Network 1105 may be connected to gateways and routers, servers, and end user computers.

Rig computing system 1100 may include, for example, a storage 1120, a memory 1125 and processor 1115. Processor 1115 may include a single processor or multiple processors. Further, processor 1115 may include different kinds of processors, such as a CPU and a GPU. Memory 1125 may include a number of software or firmware modules executable by processor 1115. Memory 1125 may include a single memory device or multiple memory devices. As depicted, memory 1125 may include a rig OS 1135 and one or more drilling applications 1140. The rig OS 1135 may be a process automation platform that manages rig equipment to execute drilling applications 1140. Drilling applications 1140 may import well plans that describe, for example, the desired drilling directions, and the rig OS performs the planned operations until the target depth is reached. the well plans may be performed at the direction of one or more drilling applications 1140. Thus, multiple drilling applications 1140 may control a single well plan. The rig OS 1135 may receive tool-agnostic instructions from the drilling applications 1140 and coordinate the instructions with the tools and other components of drilling components 1145 to implement the well plan. The drilling applications 1140 may provide instructions for drilling operations without knowing details regarding the drilling components 545, such as the specific tools or how the tools are operated. The rig OS 1135 may translate the tool-agnostic instructions to tool-specific instructions and deploy those tool-specific instructions to operate the drilling components 1145 in compliance with the well plan. As an example, the drilling application 1140 may request a tool command such as a certain top drive rotation speed, but the application may have no context to the top drive's specifications or configurations. The rig OS 1135 may take the request and translate the correct message to the rig tool. Data related to the drilling operation 1130 may be stored in a storage 1120 in the rig computing system. Storage 1120 may include a single storage device or multiple storage devices. Although components are depicted within a single computing device, the components and functionalities described with respect to the rig computing system 1100 may instead be reconfigured in a different combination or may be distributed among multiple computing devices.

Rig computing system 1100 may communicate with one or more network devices 1110 across network 1105. The rig computing system 1100 may transmit drilling data or other information from the rig computing system 1100 to the network device 1110. For example, rig computing system 1100 may transmit data related to one or more of the drilling applications 1140 to a network device 1110 associated with an entity that manages the particular drilling application 1140. Further, the network device 1110 may include end user computers or servers utilized in conjunction with rig computing system 1100.

Multiple drilling applications may be utilized during drilling. The drilling applications may be managed by different entities, such as unique operators, contractors, or owners. Thus, a first activity for a process may be directed by a first application and managed by a first entity, whereas a second activity for the process may be directed by a second application managed by a second entity. The rig computing system may toggle between utilizing the various drilling applications. Further, drilling data generated while a particular entity is controlling an activity may be partitioned into a separate storage from drilling data generated while another entity is controlling an activity. The separate storage may be, for example, a separate physical storage device, a storage partition in a physical storage device, or a different data structure on a storage device. Thus, ownership of an activity may be managed for example, based on depth, formation, or section of a well plan.

Figure 12:
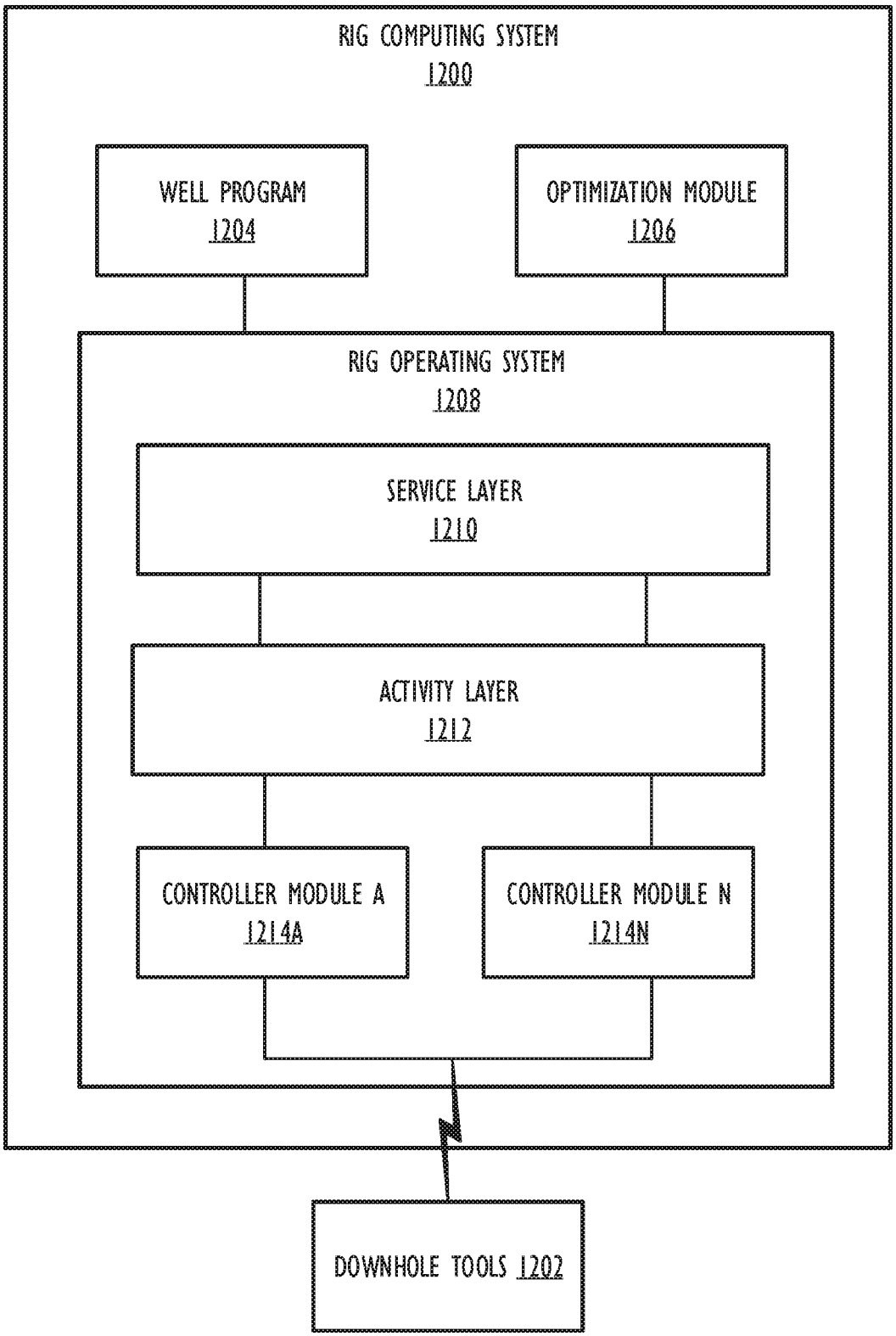
FIG. 12 is a flow diagram illustrating components of a rig computing system.

FIG. 12 is a flow diagram illustrating components of a rig computing system. Specifically, FIG. 12 provides a schematic of a data flow within the rig computing system 1200. The rig computing system 1200 may include rig applications 1206, and a rig operating system 1208. In addition, the rig computing system 1200 may include a well program 1204, which may facilitate management of the rig. The rig operating system may include several layers in which data flows. The rig operating system 1208 may receive instructions from the rig applications 1206. As described above, the rig application 1206 may provide tool-agnostic instructions. That is, rig applications 1206 may be written for generic drilling components, and the rig operating system 1208 may translate the tool-agnostic instructions into tool-specific instructions to direct the specific downhole tools 1202 accessible by the rig computing system 1200.

The rig operating system 1208 may include multiple components or layers that are utilized to translate tool-agnostic well plans into tool-specific instructions to direct downhole tools 1202 to implement the well plan. The rig operating system 1208 may include a service layer 1210, an activity layer 1212, and a set of controller modules 1214. The service layer 1210 may coordinate with a tool-agnostic request to an activity layer. The service layer may identify one or more activities required to complete a requested service or process. As an example, the service layer 1210 may receive instructions from a drilling application with instructions to perform a drill function to a particular depth or in a particular formation. The service layer 1210 may manage the activities needed to perform the different process functions required to achieve the objective from a current drilling state. The service layer 1210 may switch between processes or objectives manually based on user input or dynamically based on a predefined well plan or other instructions provided by a rig application 1206 or well program 1204. Further, the process may be dynamically switched based on a model or algorithm input. For example, the service layer 1210 may switch the process objective from drilling to tripping or to reaming based on the input.

The service layer 1210 may coordinate with the activity layer 1212 to manage the various activities required to complete the requested process or service. The activity layer may coordinate with one or more controller modules 1214 to implement a particular activity. As an example, the activity layer 1212 may identify various controller modules required to implement an activity as directed by the service layer 1210. Further, the activity layer 1212 may determine whether one or more controller modules 1214 are available for performing a necessary activity. If a controller module 1214 is not available, then the activity layer 1212 may trigger a notification such that the particular activity may be driven by a user.

The controller modules 1214 act as an abstraction layer that allows rig applications 1206 to be tool-agnostic and controller module 1214 to translate the instructions for specific downhole tools 1202 or other drilling components. Controller modules 1214 may include state machine logic to start and stop downhole tools 1202 and other components and bridge the process to the machine. The controller modules 1214 may translate tool-agnostic instructions into tool-specific instructions based on the specific downhole tools 1202 or other components available on a rig, thereby driving the tools. The controller modules 1214 may be tool specific. That is, a controller module may be associated with a particular tool or tools such that the controller module generates tool-specific instructions for that particular tool. Further, the controller modules 1214 may be associated with multiple tools or components or may be associated with a particular function of a particular tool. As an example, the top drive 130 may be utilized for processes or activities such as circulation, rotation, and pipe handling. Each of circulation, rotation, and pipe handling may be managed by a separate controller module 1214. The controller module 1214 associated with a particular tool may drive that tool to implement actions to perform the activity. Further, controller modules 1214 may be associated with particular functionality. For example, one or more controller modules 1214 may be associated with rotation, whereas another one or more controller modules 1214 may be associated with circulation. In this example, each controller module 1214 may be associated with a particular set of drilling components based on functionality and may include the capability to translate tool-agnostic instructions into tool-specific instructions for tools associated with the particular functionality.

The service layer 1210 may manage the scheduling of the various processes by the activity layer 1212 and the controller modules 1214. For example, the service layer may determine a current drilling state and, based on the drilling state, trigger the activity layer 1212 and thus the controller modules 1214 to perform an action. For example, if the objective is to drill, the controller modules 1214 may initiate pumps to prepare for a particular flow and initiate a top drive for a particular circulation.

In addition, the service layer 1210 may manage the rig applications 1206 from which instructions are received. The service layer 1210 may toggle between rig applications based on a drilling state. A drilling state may be determined based on sensor data from sensors 185. The drilling state may include contextual data either from or determined by the sensors 185 or contain environmental contextual data. For example, a first rig application 1206 may drive the drilling operation to a particular depth, at which point a second rig application 1206 may take over. Thus, the service layer 1210 may monitor a current depth or other drilling state information and toggle between the various rig applications 1206 accordingly.

Further, the well program 1204 may include a well plan, which may include a set of parameters based on formations and sections and utilized to perform drilling operations. Well program 1204 may monitor various drilling measurements to ensure that the various drilling components perform within certain thresholds. As an example, thresholds may determine safe operation of the components or may be utilized for resource management, such as power savings, or to limit wear and tear on machinery. The thresholds may be set by the well plan 1204 or another rig application 1206. Further, the thresholds may be dynamically modified, for example, through user input during operation of the rig. The thresholds may be set based on various drilling parameters, such as drilling state (e.g., a current activity, a current depth, or other contextual information). The drilling parameters may be determined, for example, based on sensor data from sensors 185. If a rig application 1206 causes a threshold to be exceeded, then the well program 1204 may modify the process or activity directed by the application such that the drilling parameter remains within a threshold. For example, if the threshold values at a particular depth indicate that the rotation should be between 125 and 550 RPM and an actual reading from a sensor on the top drive indicates that the actual rotation is 40 RPM, then the well program 1204 may override the rig application 1206 to ensure that the minimum rotation is met. Conversely, if the actual rotation is 600 RPM, then the well program 1204 may direct the rig operating system 1208 to direct the top drive to lower the rotation speed. The rotation or any other measured parameter may be increased or decreased by a predetermined measurement, a particular percentage, or any other method.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, components, techniques, or methods without departing from the scope of the present disclosure. Other items shown or discussed as coupled may be directly coupled or may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A drilling system, comprising:

a drill string comprising a downhole motor;

a plurality of sensors coupled to the drill string; and a computing system coupled to the sensors, and configured to:

compute, based on measurements provided by the sensors, a standpipe pressure index, a torque index, a flow rate index, and an RPM index;

compute a motor stall index based on the standpipe pressure index, the torque index, the flow rate index, and the RPM index;

determine, by comparing the motor stall index to a motor stall threshold, whether the downhole motor has stalled; and responsive to a determination that the downhole motor has stalled, adjust operation of the drill string to restart the downhole motor.

2. The drilling system of claim 1, wherein:

the sensors comprise a standpipe pressure (SPP) sensor; and the computing system is configured to:

compute the standpipe pressure index based on a measurement received from the standpipe pressure sensor.

3. The drilling system of claim 1, wherein:

the sensors comprise a torque sensor; and the computing system is configured to:

compute the torque index based on a measurement received from the torque sensor.

4. The drilling system of claim 1, wherein:

the sensors comprise a flow rate sensor; and the computing system is configured to:

compute the flow rate index based on a measurement received from the flow rate sensor.

5. The drilling system of claim 1, wherein:

the sensors comprise a drill string revolutions per minute (RPM) sensor; and the computing system is configured to:

compute the RPM index based on a measurement received from the RPM sensor.

6. The drilling system of claim 1, wherein the computing system is configured to compute the motor stall index as:

$$\text{MotorStallIndex}=\alpha(\text{RPMIndex}*\text{SurfaceTorqueIndex})+\beta(\text{FlowRateIndex}*\text{SPPIndex})$$

7. The drilling system of claim 6, wherein the computing system is configured to compute the RPM Index, the surface torque index, the flow rate index, and the SPP index as:

$$\text{index} = \frac{1}{1+e^{-k(-ROC+SP)}}.$$

8. The drilling system of claim 1, wherein the computing system is configured to adjust operation of the drill string to prevent the motor from stalling responsive to a determination that the downhole motor has stalled.

9. The drilling system of claim 1, wherein, to restart the downhole motor, the computing system is configured to perform any one or more of:

decrease weight on bit;

reduce torque in the drill string by reversing rotation of the drill string;

lift the drill string off a bottom of the borehole; or reduce a flow rate of drilling fluid in the drill string.

10. The drilling system of claim 1, wherein the computing system is configured to execute instructions of a machine learning model trained to determine whether the downhole motor has stalled.

11. A method for operating a drilling system, comprising:

receiving measurements from a plurality of sensors coupled to a drill string, wherein the drill string comprises a downhole motor to turn a drill bit;

computing, by a computing system coupled to the drill string and the sensors, based on measurements provided by the sensors, a standpipe pressure index, a torque index, a flow rate index, and an RPM index;

computing, by the computing system, a motor stall index based on the standpipe pressure index, the torque index, the flow rate index, and the RPM index;

determining, by the computing system, whether the downhole motor has stalled by comparing the motor stall index to a motor stall threshold; and adjusting, by the computing system, operation of the drill string to restart the downhole motor responsive to determining that the downhole motor has stalled.

12. The method of claim 11, further comprising adjusting operation of the drill string to prevent the motor from stalling responsive to a determination that the downhole motor has stalled.

13. The method of claim 11, further comprising computing, by the computing system, the motor stall index as:

$$\text{MotorStallIndex}=\alpha(\text{RPMIndex}*\text{SurfaceTorqueIndex})+\beta(\text{FlowRateIndex}*\text{SPPIndex}).$$

14. The method of claim 13, further comprising computing, by the computing system, the RPM Index, the surface torque index, the flow rate index, and the SPP index as:

$$\text{index} = \frac{1}{1+e^{-k(-ROC+SP)}}.$$

15. The method of claim 11, wherein the adjusting comprises one or more of:

decreasing weight on the drill bit;

reducing torque in the drill string by reversing rotation of the drill string;

lifting the drill bit off a bottom of the borehole; or reducing a flow rate of drilling fluid in the drill string.

16. A non-transitory computer-readable medium encoded with instructions that when executed by a processor cause the processor to:

receive measurements from a plurality of sensors coupled to a drill string, wherein the drill string comprises a downhole motor to turn a drill bit;

compute, based on the measurements received from the sensors, a standpipe pressure index, a torque index, a flow rate index, and an RPM index;

compute a motor stall index based on the standpipe pressure index, the torque index, the flow rate index, and the RPM index;

determine whether the downhole motor has stalled by comparing the motor stall index to a motor stall threshold; and adjust operation of the drill string to restart the downhole motor responsive to determining that the downhole motor has stalled.

17. The non-transitory computer-readable medium of claim 16 further encoded with instructions that when executed cause the processor to adjust operation of the drill string to prevent the motor from stalling responsive to a determination that the downhole motor has stalled.

18. The non-transitory computer-readable medium of claim 16 further encoded with instructions that when executed cause the processor to compute the motor stall index as:

$$\text{MotorStallIndex}=\alpha(\text{RPMIndex}*\text{SurfaceTorqueIndex})+\beta(\text{FlowRateIndex}*\text{SPPIndex}).$$

19. The non-transitory computer-readable medium of claim 16 further encoded with instructions that when executed cause the processor to compute the RPM Index, the surface torque index, the flow rate index, and the SPP index as:

$$\text{index} = \frac{1}{1+e^{-k(-ROC+SP)}}.$$

20. The non-transitory computer-readable medium of claim 16 further encoded with instructions that when executed cause the processor to adjust operation of the drill string by any one or more of:

decreasing weight on the drill bit;

reduce torque in the drill string by reversing rotation of the drill string;

lifting the drill bit off a bottom of the borehole; or reducing a flow rate of drilling fluid in the drill string.

* * * * *